US007673469B2

(12) United States Patent
Park et al.

(10) Patent No.: US 7,673,469 B2
(45) Date of Patent: Mar. 9, 2010

(54) ICE DISPENSER FOR A REFRIGERATOR WITH A DELAY MECHANISM HAVING A FOLDABLE CATCH

(75) Inventors: Kyong Bae Park, Seoul (KR); Nam Soo Cho, Seoul (KR); Dong Hoon Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 279 days.

(21) Appl. No.: 11/808,268

(22) Filed: Jun. 7, 2007

(65) Prior Publication Data

US 2008/0053139 A1 Mar. 6, 2008

(30) Foreign Application Priority Data

Sep. 5, 2006 (KR) ..... 10-2006-0085229

(51) Int. Cl.

| | |
|---|---|
| ***F25C 5/18*** | (2006.01) |
| ***B65B 59/00*** | (2006.01) |
| ***G05G 5/00*** | (2006.01) |
| *F25C 1/22* | (2006.01) |
| *F25D 23/00* | (2006.01) |

(52) U.S. Cl. ..... 62/344; 62/302; 62/340; 74/473.29; 74/574.3; 188/130; 188/266.1; 188/266.3; 188/266.4; 188/290; 221/15; 222/477; 251/163; 267/205

(58) Field of Classification Search ..... 62/302, 62/340, 344; 74/473.29, 574.3; 188/130, 188/266.1, 266.3, 266.4, 290, 322.19; 221/15; 222/477; 251/163; 267/205

See application file for complete search history.

(56) References Cited

U.S. PATENT DOCUMENTS

| | | | | |
|---|---|---|---|---|
| 3,218,985 | A * | 11/1965 | Walton | 417/112 |
| 3,342,040 | A * | 9/1967 | Dedricks et al. | 62/320 |
| 3,893,550 | A * | 7/1975 | San Pablo De La Rosa | 188/322.19 |
| 3,942,334 | A * | 3/1976 | Pink | 62/266 |
| 4,089,436 | A * | 5/1978 | Marks | 222/504 |
| 4,090,641 | A * | 5/1978 | Lindenschmidt | 222/504 |
| 4,109,455 | A * | 8/1978 | Zacharin | 368/327 |
| 4,759,428 | A * | 7/1988 | Seshimo | 188/312 |
| 6,135,173 | A * | 10/2000 | Lee et al. | 141/361 |
| 6,290,038 | B1 * | 9/2001 | Jensen et al. | 188/381 |
| 6,464,052 | B1 * | 10/2002 | Hsiao | 188/290 |
| 6,513,800 | B1 * | 2/2003 | Bucholtz et al. | 267/205 |
| 6,533,003 | B1 * | 3/2003 | Jacobus et al. | 141/360 |
| 6,672,575 | B2 * | 1/2004 | Flower et al. | 267/205 |
| 6,951,267 | B2 * | 10/2005 | Heo | 188/266.3 |
| 7,065,975 | B1 * | 6/2006 | Herndon et al. | 62/66 |
| 7,234,569 | B2 * | 6/2007 | Salice | 188/130 |
| 2006/0131324 | A1 * | 6/2006 | Noh et al. | 221/150 R |
| 2006/0150856 | A1 * | 7/2006 | Ambrico | 102/275.7 |

* cited by examiner

*Primary Examiner*—Cheryl J. Tyler
*Assistant Examiner*—Filip Zec
(74) *Attorney, Agent, or Firm*—Ked & Associates LLP

(57) ABSTRACT

A refrigerator with an ice dispenser includes a spiral type time delay unit for controlling the opening and closing of an ice duct. A duct cap opens and closes an ice duct formed in the refrigerator. A rotating shaft of the time delay unit is operably connected to the duct cap. Foldaway catching members on a rotating shaft intersect with a threaded cylindrical body. The catching members fold back to allow a quick opening of the ice duct. The catching members then interact with the threaded cylindrical body as the ice duct closes to delay the closing process.

18 Claims, 7 Drawing Sheets

ICE DISPENSER FOR A REFRIGERATOR WITH A DELAY MECHANISM HAVING A FOLDABLE CATCH

This application claims priority under 35 U.S.C. §119(a) to Korean Patent Application No. 10-2006-0085229, filed on Sep. 5, 2006, the entire contents of which are hereby incorporated by reference.

BACKGROUND

1. Field

The present invention relates to a refrigerator, and more particularly, to a refrigerator having an ice dispenser and a delay mechanism for delaying the closing of an ice duct of the ice dispenser.

2. Background

In general, a refrigerator is a device having a refrigerating chamber and a freezing chamber which are maintained at predetermined low temperatures. The refrigerator uses a refrigerating cycle device with a refrigerant, including a compressor, a condenser, an expander, and an evaporator.

FIG. 1 is a perspective view of a conventional refrigerator with a refrigerating chamber and a freezing chamber opened. As shown in FIG. 1, the refrigerator includes a refrigerating chamber F and a freezing chamber R, which are separated by a barrier 1. A refrigerating cycle device for keeping the refrigerating chamber F and the freezing chamber R at low temperatures is installed within the main body 2. A refrigerating chamber door 6 is coupled to the main body 2 for opening and closing the refrigerating chamber F, and a freezing chamber door 4 is coupled to the main body 2 for opening and closing the freezing chamber R.

The refrigerating cycle device typically includes a compressor for compressing a low temperature and low pressure gas refrigerant, a condenser for condensing the high temperature and high pressure refrigerant by radiating the heat of the compressed refrigerant through external air, an expander for reducing the pressure of the condensed refrigerant from the condenser, and an evaporator for absorbing the heat from air circulating around the refrigerating chamber F and/or the freezing chamber R using the expanded refrigerant.

An automatic ice maker is often mounted in the freezing chamber of the refrigerator. The automatic ice maker automatically makes ice cubes using cool air in the freezing chamber F. An ice dispenser in the freezing chamber door 4 can be used to automatically output the ice cubes in response to a user's operation.

The automatic ice maker typically includes an ice making unit 8 for freezing water to make ice cubes using cool air in the freezing chamber F. An ice bank 9 is used to store ice cubes produced in the ice making unit 8. The ice bank 9 includes a conveying member for dispensing ice cubes from the ice bank 9, and a motor 10 for rotating the conveying member. The freezing chamber door 4 includes a dispenser (not shown) for dispensing ice cubes, and for also dispensing water from a water supply (not shown).

The freezing chamber door 4 includes an ice duct 12 which guides ice cubes dispensed from the ice bank 9 to the user outside the door 4. An ice duct opening and closing unit 13 is used for opening and closing the ice duct 12.

FIG. 2 is a perspective view of an ice duct opening and closing unit of the refrigerator shown in FIG. 1, and FIG. 3 is a block diagram illustrating the elements of the automatic ice maker shown in FIG. 1.

The ice duct opening and closing unit 13 shown in FIG. 2 includes a duct cap 21 disposed to open and close the ice duct 12. A lever 22 is operated by a user to cause the duct cap 21 to selectively open and close. A micro switch 23 is turned on/off by the lever 22. A rotating shaft 24 is disposed to rotate the duct cap 21. A solenoid 25 is used to cause the rotating shaft 24 to rotate the duct cap 21 to a position that opens the ice duct 12 or to a position that closes the ice duct 12. A spring 26 is disposed to elastically bias the rotating shaft 24 and the duct cap 24 to the closed position. The refrigerator further includes a controller 30 for operating the motor 10 and the solenoid 24 in response to the input of the micro switch 23.

Hereinafter, the operation of outputting ice cubes of the conventional refrigerator will be described.

When a user pushes the lever 22, that is, a user applies force to the lever 22, the movement of the lever 22 turns the micro switch 23 on. The signal from the microswitch 23 causes the controller 30 to drive the solenoid 25 and the motor of the ice bank 9. The solenoid 25 rotates the rotating shaft 25, and the rotating shaft 25 rotates the duct cap 21, thereby opening the ice duct 12. When the motor 10 of the ice bank 9 is driven, the ice bank 9 outputs ice cubes, and the outputted ice cubes are dropped into the ice duct 12. The dropped ice cubes are outputted by the dispenser through the opened ice duct 12.

When the user releases the lever 22, that is, the user removes the force applied to the lever 22, reverse movement of the lever 22 turns off the micro switch 23. In response, the controller 30 stops the motor of the ice bank so that ice cubes are no longer removed from the ice bank. The controller will also cause the solenoid 25 to move back to its original position, but only after a predetermined period of time, for example, four seconds, has elapsed. In other words, the controller does not instantly move the solenoid back to the original position. The delay allows any ice cubes that have been removed from the ice bank to fall out of the ice duct before the duct cap closes the ice duct.

When the solenoid 25 moves back to its original position, the spring 26 rotates the rotating shaft 24, and the attached duct cap 21, back to the closed position, thereby closing the ice duct 12.

The conventional refrigerator includes the solenoid 25 for closing the duct cap after delaying it for a predetermined time as described above. The solenoid, however, increases the cost of the conventional refrigerator, and the solenoid generates noise when it operates.

BRIEF DESCRIPTION OF THE DRAWINGS

The embodiments will be described in detail with reference to the following drawings in which like reference numerals refer to like elements, and wherein.

DETAILED DESCRIPTION

Figure 1:
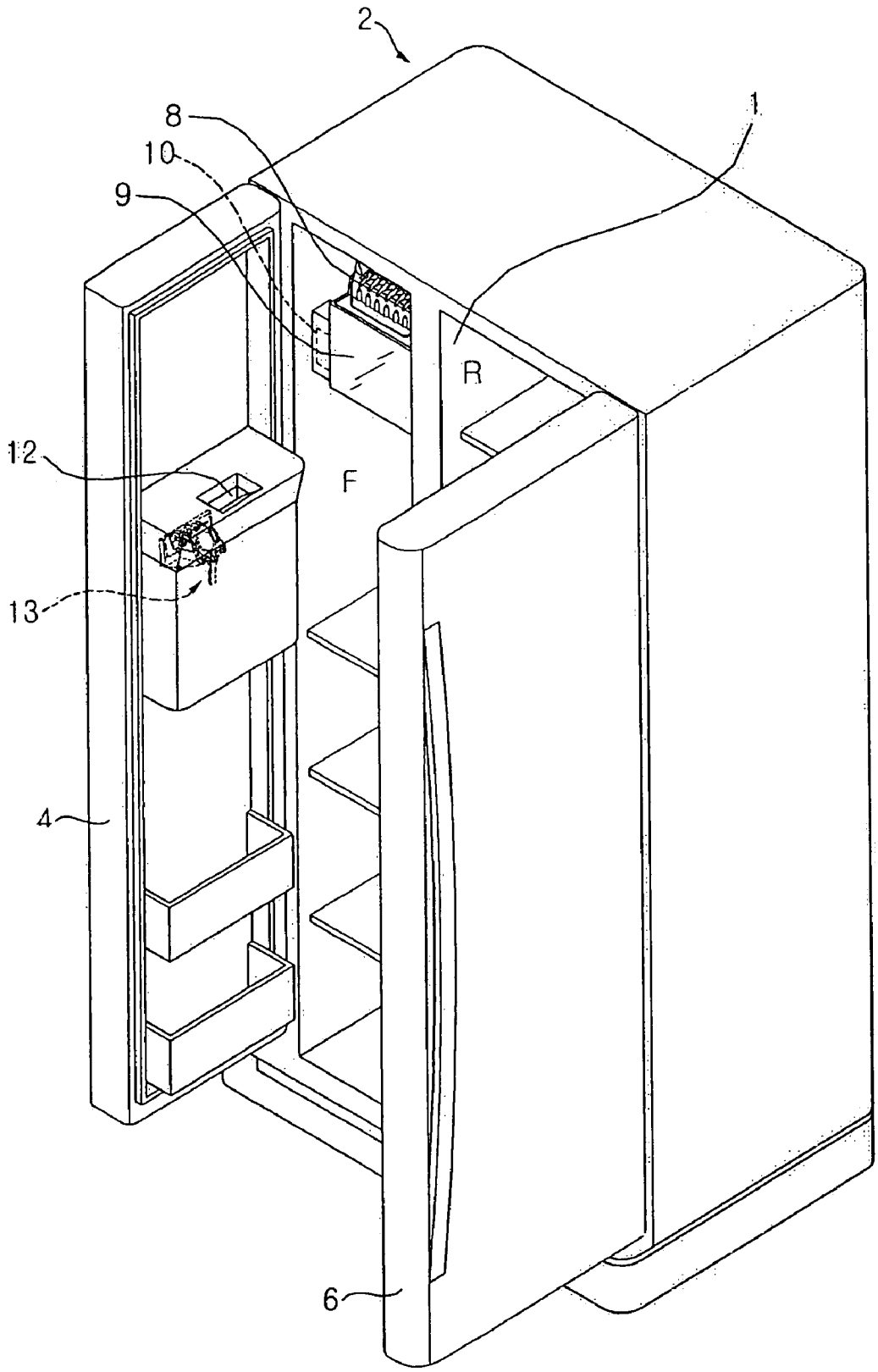
FIG. 1 (RELATED ART)
FIG. 1 is a perspective view of a related art refrigerator with a refrigerating chamber and a freezing chamber opened.
Figure 2:
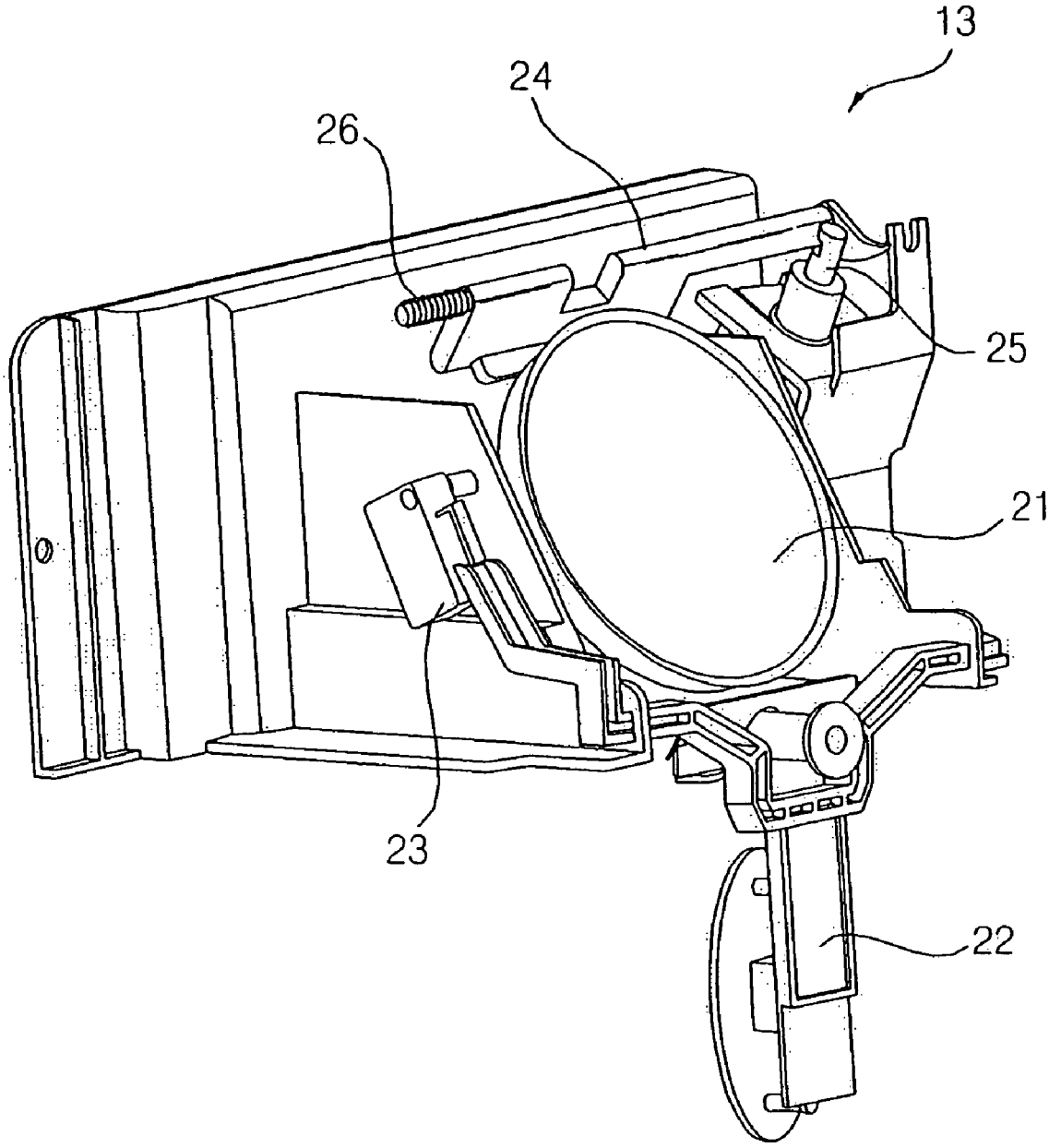
FIG. 2 (RELATED ART)
FIG. 2 is a perspective view of an ice duct opening and closing unit for a refrigerator as shown in FIG. 1.
Figure 3:
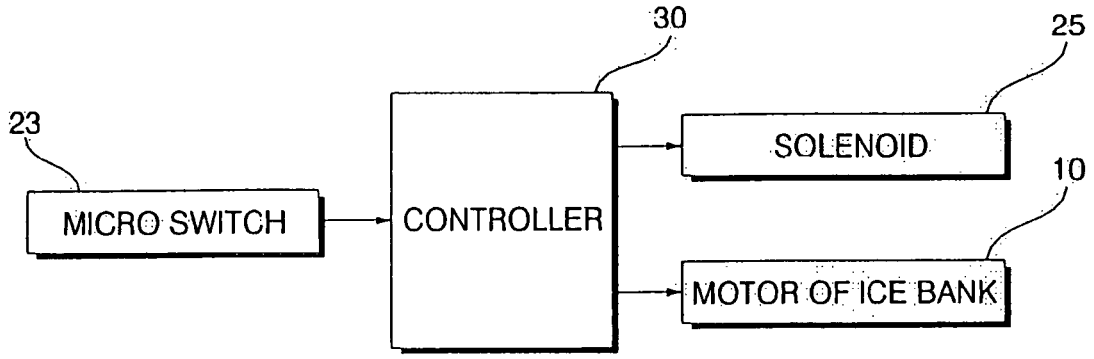
FIG. 3 (RELATED ART)
FIG. 3 is a block diagram illustrating elements of an automatic ice maker for a refrigerator as shown in FIG. 1.
Figure 4:
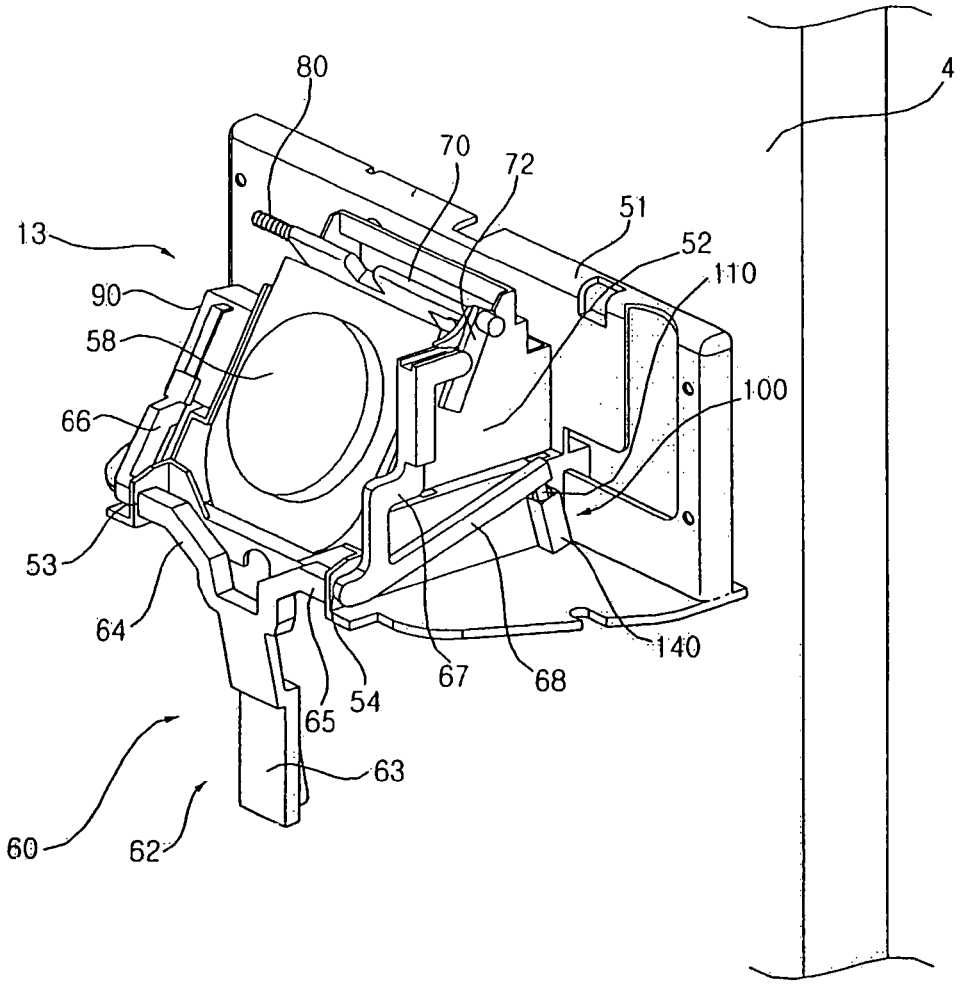
FIG. 4 is a perspective view of an ice duct opening and closing unit of a refrigerator according to a first embodiment.

FIG. 4 is a perspective view of an ice duct opening and closing unit of a refrigerator according to a first embodiment. The refrigerator according to the first embodiment includes an ice duct opening and closing unit 13 for opening and closing an ice duct 12 in response to the operation of a user. The ice duct opening and closing unit 13, as shown in FIG. 4, includes a funnel 51 mounted on a freezing chamber door 4 through joint members such as screws. The funnel 51 serves as an installation plate for rotatably supporting a lever 62 and a duct cap shaft 70 of an opening and closing unit. The funnel 51 prevents ice cubes output from the ice duct 12 from bouncing in a forward direction or a side direction of the dispenser. A duct unit 52 is formed at the bottom of the ice duct 12.

A micro switch 90 is disposed on the funnel 51. The microswitch 90 is activated by a lever 62 of the opening and closing unit 60. It is preferable to dispose the micro switch 90 at the side of the duct unit 52.

The ice duct opening and closing unit 13 includes a duct cap 58 for opening and closing the ice duct 12. An opening and closing unit 60 for opening and closing the duct cap 58 includes a spiral type time delay unit 100 for delaying closing of the duct cap when the opening and closing unit 60 closes the duct cap 58.

The duct cap 58 is rotatably or slidably mounted on the ice duct 12. Hereinafter, an embodiment will be described where the duct cap 58 is rotatably mounted. However, in other embodiments, the duct cap could also be mounted so that it moves in different fashions.

The duct cap 58 is disposed to rotate in forward and backward directions along a top edge thereof. That is, the duct cap 58 is inserted inside the duct unit 52 of the funnel 51 so that it can rotate to open or close the ice duct 12.

The opening and closing unit 60 opens and closes the duct cap 58 manually. The opening and closing unit 60 includes a lever 62 operated by a user, and a duct cap shaft 70 mechanically connected to the lever 62 for rotating the duct cap 58. The opening and closing unit 60 further includes a spring 80 for elastically supporting at least one of the lever 62 and the duct cap shaft 70 to bias the duct cap 58 towards the closed position. In this embodiment, the spring 80 has one side connected to the funnel 51 and the other side connected to the duct cap shaft 70. The spring 80 can be a coil spring or a torsion spring.

The lever 62 includes a vertical bar 63 disposed inside the dispenser such that it can be pushed by a user in a backward direction. Left and right horizontal bars 64 and 65 extend from the top of the vertical bar 63 to the right side and the left side, respectively. The horizontal bars are rotatably supported by the lever supporting units 53 and 54 formed at the left and right bottom ends of the duct unit 52. A switch connecting bar 66 extends from one of the left and right horizontal bars 64 and 65 for turning on/off the micro switch 90. A duct cap connecting bar 67 extends from the other of the left and right horizontal bars 64 and 65 and is connected to or interacts with the duct cap shaft 70.

The duct cap shaft 70 is disposed at a top side of the duct unit 52 of the funnel 51. The duct cap shaft 70 is rotatably supported by a shaft supporting member formed at the top side of the duct unit 52 of the funnel 51. The duct cap shaft 70 includes a connecting member 72, which interacts with the duct cap shaft connecting bar 67. The lever 62 is also coupled to a time delay connecting bar 68 which operates a time delay unit 100. Thus, the lever 62 is operably connected to a rotating shaft 110 in the time delay unit 100. Hereinafter, the time delay connecting bar will be described as a rotating shaft connecting bar 68.

The time delay unit 100 is connected to one of the duct cap 58 and the opening and closing unit 60 and operates to delay closing of the duct cap 58 when the opening and closing unit 60 closes the duct cap 58. It is preferable that the time delay unit 100 not disturb the rotation of the lever 62 and the duct cap shaft 70 as they move from the closed to the open position, thereby allowing the duct cap to quickly open. It is also preferable that the time delay unit 100 be configured to delay closing of the duct cap for a predetermined period of time, and then allow the lever 62 and the duct cap shaft 70 to move quickly toward the closed position after the predetermined time period has expired.

Figure 5:
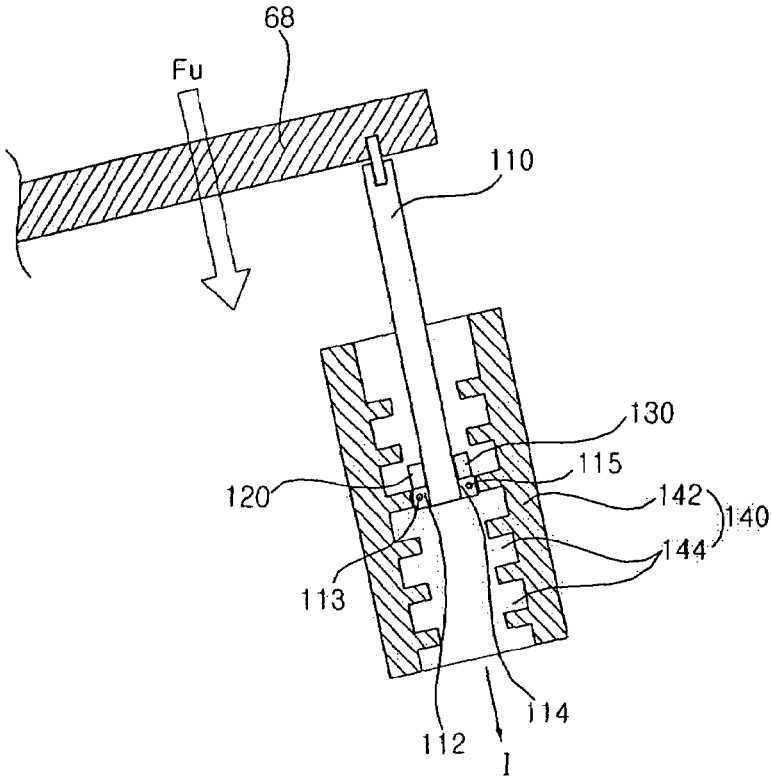
FIG. 5 is a cross-sectional view of a time delay unit while opening a duct cap of the mechanism shown in FIG. 4.
Figure 6:
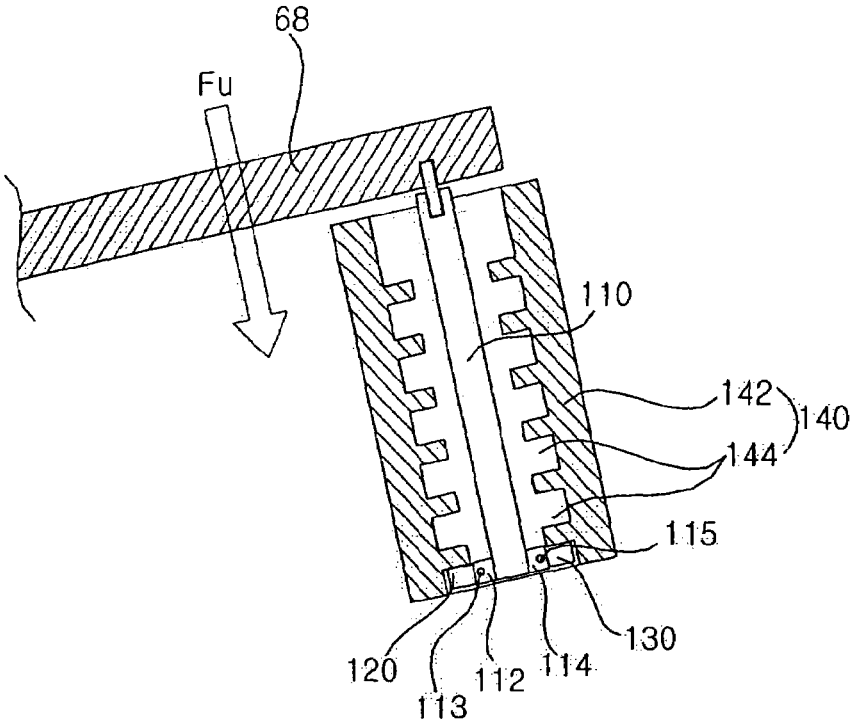
FIG. 6 is a cross-sectional view of the time delay after opening a duct cap of the mechanism shown in FIG. 4.
Figure 7:
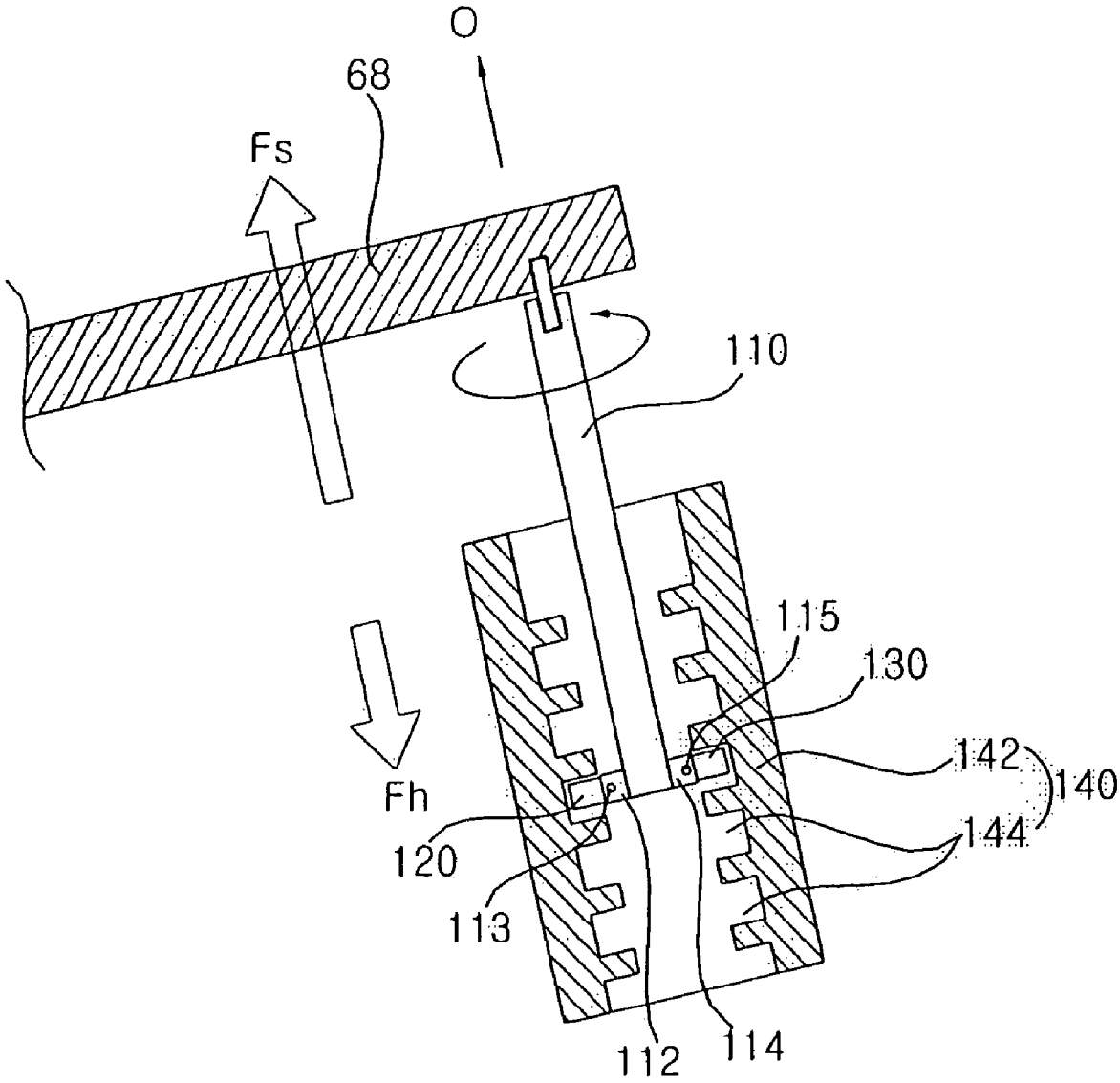
FIG. 7 is a cross-sectional view of the time delay while closing a duct cap of the mechanism shown in FIG. 4.
Figure 8:
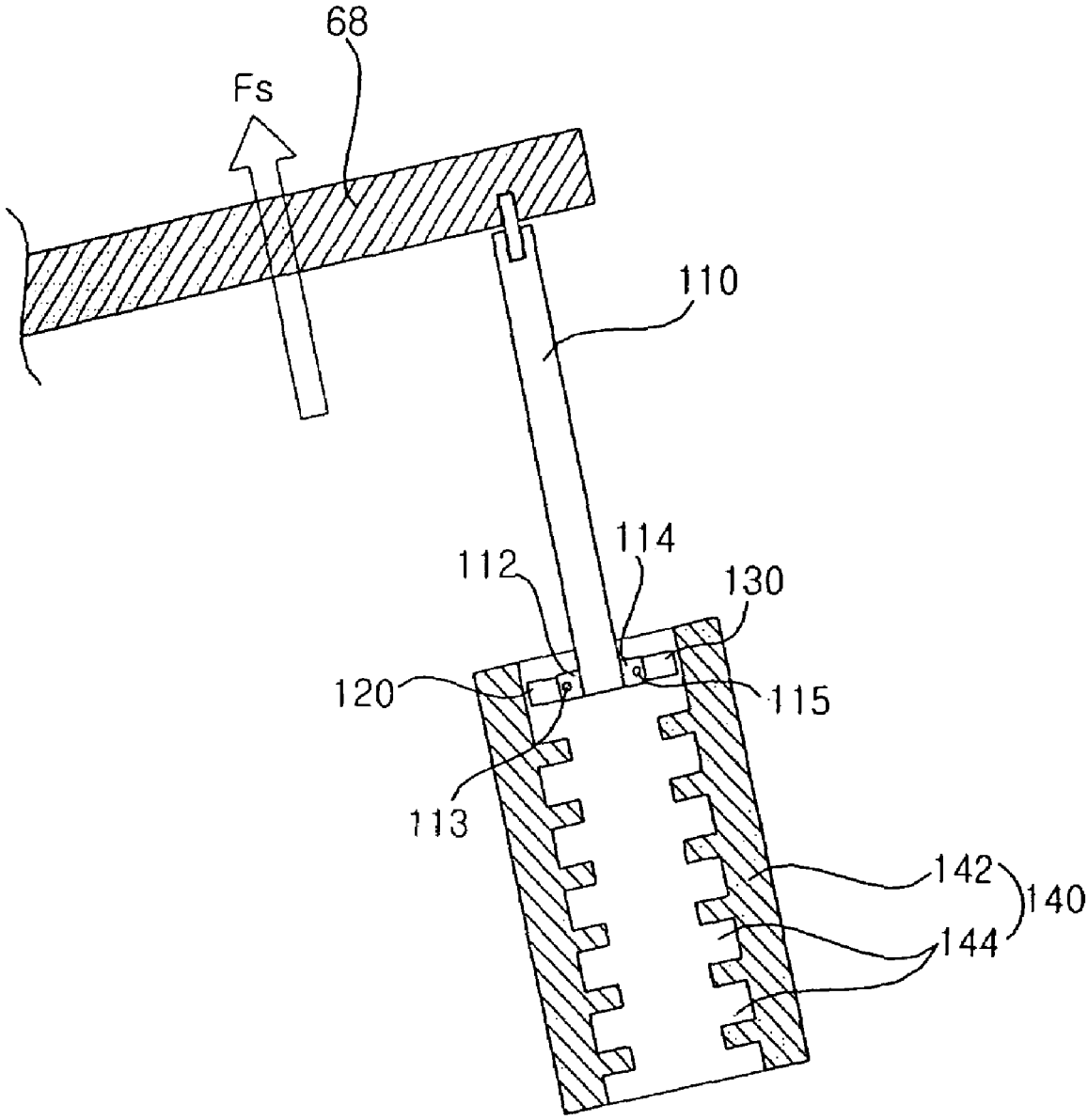
FIG. 8 is a cross-sectional view of the time delay after closing a duct cap of the mechanism shown in FIG. 4.

FIG. 5 is a cross-sectional view of the time delay unit in an operational state where it is moving while the duct cap shown is opening. FIG. 6 is a cross-sectional view of the time delay unit after the duct cap has opened. FIG. 7 is a cross-sectional view of the time delay unit in an operational state where it is moving while the duct cap is closing. FIG. 8 is a cross-sectional view of the time delay unit after the duct cap has closed.

The time delay unit 100 includes a rotating shaft 110 that is rotatably connected to the rotating shaft connecting bar 68, which itself is connected to the lever 62 of the opening and closing unit 60. Foldaway catching members 120 and 130 are rotatably mounted on the end of the shaft 110 such that they can bend in one direction. A screw member 140 is formed on the inside wall of the time delay unit 100. The screw thread member 140 causes the foldaway catching members 120 and 130 to bend, as shown in FIG. 6, when the rotating shaft 110 moves in an insertion direction I. When the rotating shaft 110 moves in a withdrawal direction (O), as shown in FIG. 7, the screw thread member 140 interacts with the catching members 120 and 130 to cause the shaft 110 to rotate.

As shown in FIG. 6 through FIG. 8, the rotating shaft 110 includes hangers 112 and 114 to allow the foldaway catching members 120 and 130 to be folded to the side of the shaft 110 such that they are approximately parallel to the rotating shaft 110. In some embodiments, however, the foldaway catching members may not fold all the way up so that they become parallel to the shaft 110. In other words, they may fold upward so that they are at an angle with respect to the shaft 110. The foldaway catching members 120 and 130 may be connected to the hangers 112 and 114 through hinge members 113 and 114, such as a hinge or a pin.

The foldaway catching members 120 and 130 are connected to the hangers 112 and 114 so that they can be unfolded to a position approximately perpendicular to the rotating shaft 110, and so that they can fold upward to be parallel with the rotating shaft 110. The foldaway catching members 120 and 130 are formed in a stick shape, such as a circular cylinder shape or a square column shape. The hangers 112 and 114 are formed to have a U shaped cross section, and include holes at both sides thereof to install the hinge members 113 and 114.

The foldaway catching members 120 and 130 are caught by the bottom ends of the hangers 112 and 114, so that the foldaway catching members 120 and 130 can only rotate downward until they are perpendicular to the rotation shaft 110. However, the foldaway catching members 120 and 130 can be freely folded upward through the opened top side of the hangers 112 and 114 so that they can be positioned parallel to the rotating shaft 110.

It is preferable that the time delay unit include a plurality of the foldaway catching members 120 and 130. It is also preferable that the plurality of the foldaway catching members 120 and 130 are connected symmetrically along the sides of the rotating shaft 110.

The screw member 140 is formed in a hollow cylindrical shape to allow the rotating shaft 110 to move forwardly and backwardly within the hollow cylinder. The cylindrical screw member is positioned on the funnel 51 such that when the lever 62 is moved by a user, the rotating shaft 110 will advance straight down into the cylindrical cavity.

The screw member 140 includes a screw thread 144 formed on the inner circumference of an outer body 142 having a hollow cylindrical shape. The screw threads 144 bend the foldaway catching members 120 and 130 to a position parallel to the rotating shaft 110 when the rotating shaft 110 moves in an insertion direction (I). However, when the rotating shaft 110 moves in a withdrawal direction (O) the foldaway catching members 120 and 130 rotate to a deployed position perpendicular to the shaft and are caught in the threads.

The longer the length of the screw groove 144, the longer the foldaway catching members 120 and 130 will rotate as the shaft 110 moves in the withdrawal direction. Also, the longer length of the screw groove 144, the greater the friction between the screw groove 144 and the foldaway catching members 120 and 130. Therefore, to lengthen a delay time for closing the duct cap 58, one can increase the length of the screw groove 144. On the other hand, to shorten the delay time, one can shorten the length of the screw groove 144.

Figure 9:
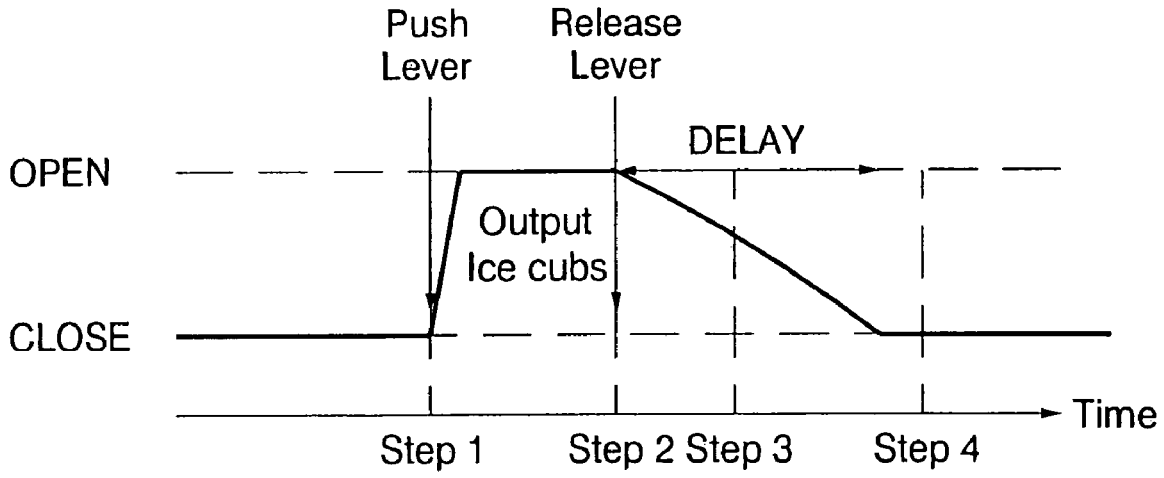
FIG. 9 is a diagram illustrating a duct cap closing and opening according to the operation of the mechanism shown in FIG. 4.

FIG. 9 is a diagram illustrating a process where a duct cap is closing and opening using the mechanism shown in FIG. 4. When a user pushes the vertical bar 63 of the lever 62, the horizontal bars 64 and 65 rotate on the lever supporting units 53 and 54 of the funnel 51. As a result, the duct cap connecting bar 67 rotates the duct cap shaft 70. Rotation of the duct cap shaft 70 elastically deforms the spring 80, and rotates the duct cap 58 so that it starts opening the ice duct 12.

When the duct cap shaft connecting bar 67 rotates the duct cap shaft 70 and the duct cap 58 as described above, the opening force (Fu) is applied to the rotating shaft 110 as shown in FIG. 5. As a result, the rotating shaft 100 moves to the bottom of the screw member 140, as shown in FIG. 6.

While the rotating shaft 100 moves downwardly, the foldaway catching members 120 and 130 assume a position approximately parallel with the rotating shaft 110. As noted above, in some embodiments, the foldaway catching members may not rotate fully upward so that they are parallel to the shaft. Instead, they may only rotate partially upward so that they are at an angle with respect to the shaft. In any event, because the foldaway catching members can rotate upward with respect to the shaft, the rotating shaft 110 and the foldaway catching members 120 and 130 quickly move to the bottom of the screw member 140 through the internal space of the screw groove 144.

Once, the rotating shaft 110 is deeply inserted into the bottom of the screw member 140, shown in FIG. 6, the foldaway catching members 120 and 130 assume the deployed position where they are perpendicular to the rotating shaft 110. In some embodiments, the foldaway catching members may be spring loaded so that they automatically move to the deployed position once the shaft is fully inserted in the screw member 140. At this point, the duct cap 58 completely opens the ice duct 12.

The movement of the lever 62 also causes the switch connecting bar 66 to turn on the micro switch 90. As a result, the controller 30 receives a signal from the micro switch 90, which causes the controller 30 to drive the motor 10 of the ice bank 9. When the motor 10 of the ice bank 9 is driven, ice cubes contained in the ice bank 9 are dropped into the ice duct 12, and the ice cubes are output from the dispenser through the opened ice duct 12 and the duct unit 52 of the funnel 51.

When a user releases the lever 62, the spring 80 acts to rotate the duct cap 58 back to the closed position. When the duct cap shaft 70 and the lever 62 begin to rotate towards the closed position, the switch connecting bar 66 of the lever 62 turns off the micro switch 90. As a result, the controller 30 stops the motor of the ice bank 9, and ice cubes are no longer removed from the ice bank 9.

The restoring force of the spring 80 is also applied to the rotating shaft 110. This force is shown as (Fs) in FIG. 7. The force (Fs) acts to pull the rotating shaft 110 out of the housing 142. The movement of the rotating shaft upward also rotates the rotating shaft 110 because the restoring force (Fs) of the spring 80 is greater than the frictional force of the screw groove 144. The foldaway catching members 120 and 130 are guided along the screw groove 144, thereby moving toward the top of the screw member 140, as shown in FIG. 7.

Because the foldaway catching members 120 and 130 rotate along the screw groove 144 while rubbing the screw groove 144, it takes a certain amount of time for the catching members 120 and 130 to move toward the top of the screw groove 144. This delays the closing the ice duct 12. The delay ensures that any ice cubes removed from the ice bank 9 fall through the ice duct 12 before the duct cup 58 closes.

When the foldaway catching members 120 and 130 move to a position above the top of the screw groove 144, the frictional force between the foldaway catching members 120 and 130 and the screw groove 144 disappears, and the restoring force (Fs) of the spring 80 is used to quickly move the duct cap 58 to the closed position.

The foregoing exemplary embodiments and aspects of the invention are merely exemplary and are not to be construed as limiting the present invention. The present invention can be applied to a refrigerator having the ice maker 8 and the ice bank 9 mounted at the rear side of the freezing chamber door 4. The present teaching can be readily applied to other types of apparatuses. Also, the description of the exemplary embodiments of the present invention is intended to be illustrative, and not to limit the scope of the claims, and many alternatives, modifications, and variations will be apparent to those skilled in the art.

The refrigerator and ice dispensing mechanism described above have several advantages. The mechanical time delay unit, having the rotating shaft, the foldaway catching members, and the screw member, act to delay closing of the duct cap without the need for a separate electrically operated solenoid. Therefore, the cost and the operation noise can be minimized compared to a refrigerator with a solenoid. In addition, the foldaway catching members are folded by the screw member and are automatically unfolded. Therefore, a simple structure can smoothly open the duct cap and delay closing the duct cap. Further, because the duct cap shaft and the mechanical time delay unit can be connected through one lever, the structure can be simplified and the number of parts can be minimized.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although a number of illustrative embodiments have been described, it should be understood that numerous other modifications and embodiments can be devised by those skilled in the art that will fall within the spirit and scope of the principles of this disclosure. More particularly, variations and modifications are possible in the component parts and/or arrangements of the subject combinations while still falling within the scope of the disclosure, the drawings and the appended claims. In addition to variations and modifications in the component parts and/or arrangements, alternative uses will also be apparent to those skilled in the art.

What is claimed is:

1. A refrigerator, comprising:

a main body;

an ice dispenser mounted on the main body and having an ice duct for dispensing ice;

a duct cap that moves between an open position and a closed position to open and close the ice duct; and a delay unit that delays movement of the duct cap between the open and closed positions for a predetermined period of time, wherein the delay unit comprises:

a hollow, elongated body having screw threads on an inner surface;

a shaft mounted within the hollow body, wherein the shaft is operably coupled to the duct cap such that the shaft moves into and out of the hollow body as the duct cap moves between the open and closed positions; and folding catch members mounted on the shaft, wherein the folding catch members move between a folded position where they are folded back against the shaft and a deployed position where they extend out from the shaft.

2. The refrigerator of claim 1, wherein when the duct cap opens and the shaft is moving into the hollow body, the folding catch members assume the folded position so that the shaft can move easily and quickly into the hollow body, thereby allowing the duct cap to quickly and easily open.

3. The refrigerator of claim 2, wherein when the duct cap closes and the shaft is moving out of the hollow body, the folding catch members assume the deployed position.

4. The refrigerator of claim 3, wherein when the shaft is moving out of the hollow body, and the folding catch members are in the deployed position, the folding catch members interact with the screw threads to cause the shaft to rotate.

5. The refrigerator of claim 4, wherein the interaction between the folding catch members and the screw threads causes the shaft to move slowly out of the hollow body, thereby causing the duct cover to move slowly from the open to the closed position.

6. The refrigerator of claim 1, wherein the folding catch members are attached to the shaft by hinges that allow the folding catch members to rotate between the folded and deployed positions.

7. The refrigerator of claim 6, wherein the hinges include stoppers that hold the folding catch members in the deployed position.

8. The refrigerator of claim 1, wherein when the shaft is moving into the hollow body, contact between the folding catch members and the screw threads causes the folding catch members to move to the folded position.

9. The refrigerator of claim 1, wherein the folding catch members are biased towards the deployed position.

10. The refrigerator of claim 1, further comprising:

a lever that is operably coupled to the duct cap, wherein the lever can be operated by the user to move the duct cap to the open position; and a spring that is operably coupled to the duct cap and that biases the duct cap towards the closed position.

11. The refrigerator of claim 1, wherein the duct cap is rotatably mounted on the ice dispenser such that it rotates between the open and closed positions.

12. A refrigerator, comprising:

a main body;

an ice dispenser mounted on the main body and having an ice duct for dispensing ice;

a duct cap that moves between an open position and a closed position to open and close the ice duct; and a delay unit that delays movement of the duct cap between the open and closed positions for a predetermined period of time, wherein the delay unit comprises:

a hollow, elongated body having screw threads on an inner surface:

a shaft mounted within the hollow body, wherein the shaft is operably coupled to the duct cap such that the shaft moves into and out of the hollow body as the duct cap moves between the open and closed positions;

folding catch members mounted on the shaft, wherein the folding catch members move between a folded position where they are folded back against the shaft and a deployed position where they extend out from the shaft;

a lever that is operably coupled to the duct cap, wherein the lever can be operated by the user to move the duct cap to the open position; and a spring that is operably coupled to the duct cap and that biases the duct cap towards the closed position, wherein the shaft is coupled to the lever such that when a user pushes the lever, the shaft moves into the hollow body.

13. A refrigerator, comprising:

a main body;

an ice dispenser mounted on the main body and having an ice duct;

a duct cap that is rotatably mounted on the ice dispenser and that moves between open and closed positions that open and close the ice duct; and a delay unit that is operably coupled to the duct cap and that acts to delay a closing operation of the duct cap, wherein the delay unit includes a screw mechanism to provide the delay, the screw mechanism comprising:

a hollow cylindrical body having internal threads; and a shaft that moves into and out of the hollow cylindrical body as the duct cap moves between the open and closed positions, wherein folding catch members are mounted on the shaft and wherein the folding catch members are movable between folded positions adjacent the shaft and deployed positions where the catch members extend out away from the shaft.

14. The refrigerator of claim 13, wherein when the shaft is moving in a first direction within the hollow body, the threads cause the folding catch members to move to the folded position.

15. The refrigerator of claim 14, wherein when the shaft is moving in a second direction within the hollow body, the folding catch members assume the deployed position and interact with the threads to cause the shaft to rotate.

16. The refrigerator of claim 15, wherein the folding catch members are biased towards the deployed position.

17. The refrigerator of claim 13, wherein the folding catch members are hinged to the shaft.

18. A refrigerator comprising:

an ice duct for conveying ice to outside the refrigerator;

a duct cap for opening and closing the ice duct;

an opening and closing unit connected to the duct cap to open and close the duct cap; and a spiral time delay unit having folding catch members connected to the opening and closing unit, wherein the catch members rotate along a threaded member to delay closing of the duct cap, wherein the catch members move between a folded position where they are folded back against the shaft and a deployed position where they extend out from the shaft.

* * * * *